United States Patent [19]

Loermans

[11] Patent Number: 4,618,407

[45] Date of Patent: Oct. 21, 1986

[54] GALVANO-TECHNICAL DEVICE FOR LOCALLY APPLYING A METAL LAYER TO AN ELONGATE METAL TAPE OR THE LIKE

[75] Inventor: Peter J. G. Loermans, BW Bergharen, Netherlands

[73] Assignee: Meco Equipment Engineers B.V., Netherlands

[21] Appl. No.: 578,581

[22] Filed: Feb. 9, 1984

[51] Int. Cl.[4] ..... C25D 17/00; C25D 17/16

[52] U.S. Cl. ..... 204/206; 204/224 R; 204/225

[58] Field of Search ..... 204/206, 224 R, 225

[56] References Cited

U.S. PATENT DOCUMENTS

| | | | |
|---|---|---|---|
| 3,539,490 | 11/1970 | Gannoe, Jr. | 204/224 R |
| 4,119,499 | 10/1978 | Eidschun, Jr. | 204/224 R X |
| 4,220,504 | 9/1980 | Hanley et al. | 204/224 R X |

FOREIGN PATENT DOCUMENTS

| | | | |
|---|---|---|---|
| 2501480 | 7/1975 | Fed. Rep. of Germany | 204/224 R |
| 188817 | 11/1966 | U.S.S.R. | 204/224 R |

*Primary Examiner*—Donald R. Valentine

*Attorney, Agent, or Firm*—Spensley Horn Jubas & Lubitz

[57] ABSTRACT

A galvano-technical device for locally applying a metal layer to an elongate metal tape or to metal objects united in an elongate tape or the like in which the tape is guided along a roller adapted to rotate about a rotary axis in operation and being dipped at least partly in an electrolyte solution and in which the tape is displaced parallel to the rotary axis of the roller in a manner such that the parts of the tape to be provided with the metal layer come into contact with the roller whereby the device comprises a guide surface being stationary during operation in the direction of displacement of the tape, along which surface the tape is displaced during operation, and a guide rim extending parallel to the rotary axis of the roller and protruding out of the guide surface for the edge of the elongated tape remote from the roller, against which rim the edge of the elongate tape is pressed with the aid of wheels pressing the tape against the guide surface and having their rotary axes at an acute angle to the direction of displacement of the tape.

18 Claims, 7 Drawing Figures

GALVANO-TECHNICAL DEVICE FOR LOCALLY APPLYING A METAL LAYER TO AN ELONGATE METAL TAPE OR THE LIKE

The invention relates to a galvano-technical device for locally applying a metal layer to an elongate metal tape or to metal objects united in an elongate tape or the like in which the tape is guided along a roller adapted to rotate about a rotary axis during operation and being dipped at least partly in an electrolyte solution, whilst the tape is displaced parallel to the rotary axis of the roller in a manner such that the parts of the tape to be provided with the metal layer come into contact with the roller.

Such a device is known from U.S. patent specification No. 4,119,499 and is often used for locally applying a film of metal, frequently precious metal to, for example, parts used in the electronic industry as switching or connecting elements. In this case, on the one hand a satisfactory coating with precious metal is required, whereas on the other hand for reasons of costs the consumption of the precious metals for the application of the metal layer has to be minimized.

In the device known from U.S. Pat. No. 4,119,499 the elongate tape is guided between two endless belts along the roller. A first problem involved herein is the correct insertion of the elongate tape between the relatively co-operating belts. In the known device a toothed wheel is used for this purpose, the teeth of which grip into recesses provided in the elongate tape. Recesses solely serving to guide the tape will increase the costs, whilst it will not always be possible to make such recesses. The assembly of the two endless belts with the elongate tape to be worked sandwiched between said belts is passed through a slot in a supporting member arranged near the roller. Apart from the frictional forces involved giving rise to heavy wear of the belts it will usually not be possible to avoid slight reciprocatory movements of the elongate tape transverse of the direction of length thereof, which will adversely affect the correct application of the coating of precious metal or the like to the elongate tape.

A further disadvantage of this known device resides in the complicated structure required for correctly guiding the belts through the device and the elongate tape to be worked between the belts.

The device embodying the invention comprises a guide surface which is stationary during operation and along which the tape is displaced in operation and a guiding rim extending parallel to the rotary axis of the roller and protruding out of the guiding surface for the edge of the elongate tape remote from the roller, against which rim the edge of the elongate tape is pressed with the aid of wheels pressing the tape against the guiding surface and having their rotary axes at an acute angle to the direction of displacement of the tape.

By using the design according to the invention a simple structure of the device can be obtained, whilst during the displacement the elongate tape is constantly pressed against a stationary guide rim so that correct positioning of the elongate tape with respect to the roller rotating about the rotary axis and hence correct positioning of the metal layer to be applied with respect to the elongate tape are invariably ensured.

It is noted that U.S. Pat. No. 4,010,083 describes a device in which a cylinder partly dipped in an electrolyte solution is provided at one end with a narrow, protruding rim. Along this rim is guided a metal tape to be coated with precious metal parallel to the rotary axis of the cylinder. A first disadvantage of this device is that there is only a quite transient contact between the cylinder and a tape part to be coated, unless the tape is displaced with an unacceptable low speed with regard to the required production capacity. A second disadvantage is that the tape is not guided so that due to its contact with the cylinder the tape will vibrate transversely of its direction of length, which will destroy the desired accuracy of the application of the coating.

BRIEF DESCRIPTION OF THE DRAWINGS

The invention will be described more fully hereinafter with reference to the accompanying drawing showing a potential embodiment of a device in accordance with the invention.

Figure 1:
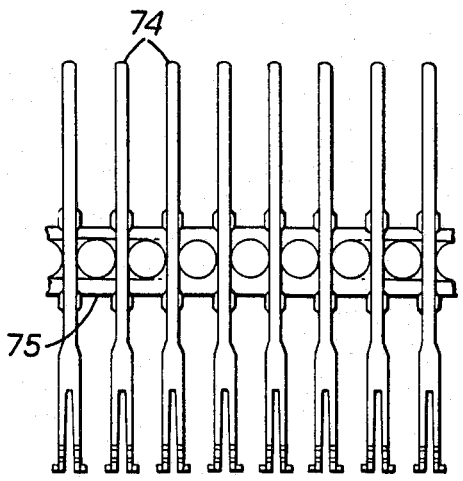
FIG. 1 is an elevational view of part of a potential embodiment of an elongate metal tape comprising a plurality of objects to be locally provided with a metal layer.
Figure 2:
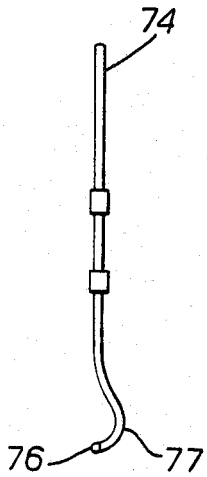
FIG. 2 is a side elevation of the embodiment of FIG. 1.

The galvano-technical device embodying the invention comprises an elongate, channel-section reservoir 1. To the ends of the reservoir are fastened U-shaped ears 2 located between set nuts 3 and 4 screwed onto stub shafts 5. The lower ends of the stubs 5 are screwed into nuts 6 welded to a supporting frame 7', which may also serve to support further devices (not shown) with the aid of which the tape to be worked in the device embodying the invention may be subjected to further treatments.

It will be obvious that by turning the set nuts 3 and 4 the reservoir 1 is adjustable in a direction of height. At a given distance from the bottom of the reservoir 1 there is arranged a plate 7 extending parallel to the bottom of the reservoir and having a passage 8. Above the plate 7 the reservoir has an anode 9.

To the bottom of the reservoir 1 is fastened a length of pipe 10 extending downwards from said bottom and having its lower end arranged in a feed pipe 11 fastened to the frame. The lower end of the length of pipe 10 is sealed with respect to the inner wall of the length of pipe 11 with the aid of a sealing ring 12.

Above the outlet of the feed pipe 10 in the reservoir 1 there is arranged a semi-circular covering hood 13, which laterally conducts away the electrolyte fed to the reservoir 1 so that this electrolyte spreads throughout the length of the reservoir 1 below the plate 7 before it flows through the openings 8 to the upper part of the reservoir. Electrolyte flowing across the top rims of the reservoir can be conducted away through an outlet pipe 14 connected with the frame 7'.

Above the reservoir 1 a roller 15 is arranged so that it is rotatable about a horizontal rotary axis 16. The roller 15 comprises a central shaft 17 to which two aligned, cylindrical bodies 18 and 19 are fastened. The outer circumference of the roller is formed by a coating layer 20 applied to said cylindrical bodies 18 and 19 and made from moisture-absorbing material. The disposition of the roller is such that, as will be apparent in particular from FIG. 4, the lower part of the roller is dipped in the electrolyte contained in the reservoir 1. Thus when the roller 15 is rotated in operation the electrolyte can be carried upwards by the moisture-absorbing layer 20.

The ends of the shaft 17 are provided with stubs 21 and 22 which are rotatably journalled in bearings 23 and 24 supported by plates 25 and 26 respectively fastened to the frame 7'.

One end of the stub shaft 22 has fastened to it a toothed belt pulley 27, which is coupled through a toothed belt 28 with a toothed belt pulley 29 which can be rotated by a drivng motor 30.

Figure 4:
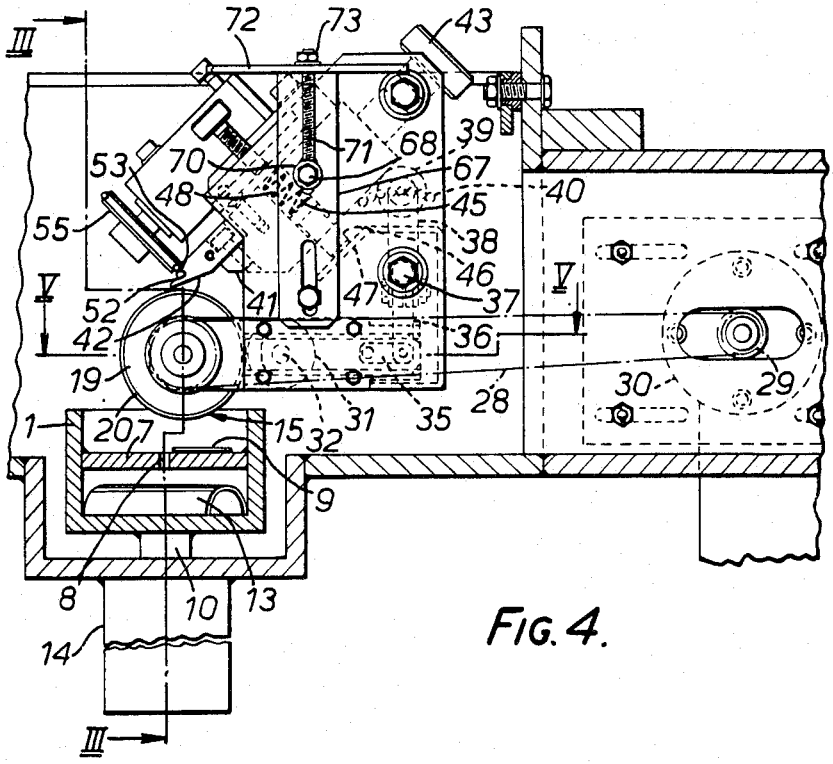
FIG. 4 is a sectional view of the embodiment of FIG. 3 taken on the line IV—IV in FIG. 3.

A pressure roller 31 is arranged parallel to and, as viewed in FIG. 4, behind the roller 15 in a manner such that the rotary axis of the roller 31 is located in the same horizontal plane as the rotary axis 16 of the roller 15. The ends of the roller 31 are provided with stub shafts 32 with the aid of which the roller 31 is freely rotatable about its rotary axis and journalled in supporting strips 33, which are supported by plates 25 and 26 in a manner such that these supporting strips are displaceable in a horizontal direction and at right angles to the rotary axis of the roller 31. The supporting strips are coupled with one another by means of a rod 34 extending parallel to the roller 31. The rod 34 is pivotally connected with the aid of a coupling rod 35 with the lower end of an arm 36, the top end of which is fixed to a shaft 37 extending parallel to the rod 34 and being rotatably journalled in the plates 25 and 26. With one end of the shaft 37 is coupled an upwardly extending arm 38 which is provided with a locking knob 39 which can be caused, for guarding the shaft 37 in a given position, to engage one of a plurality of locking openings 40 in the plate 25 located on an arc of a circle concentric with the centre line of the shaft 37. It will be obvious that by turning the arm 38 the roller 31, as viewed in FIG. 4, can be shifted in a horizontal direction to the left or to the right so that it can be pressed more or less tightly against the moisture-absorbing surface layer 22 of the roller 15 in order to expell excess fluid from this layer.

Above and, as viewed in FIG. 4, on the right-hand side of the roller 15 an elongate supporting block 41 extends parallel to the roller, to which block is fastened a guide member 42 for guiding the elongate tape to be worked.

The supporting block 41 is connected with the aid of two set bolts 43 extending normal to the direction of length of the supporting block with a supporting rod 44 so that with the aid of the set bolts 43 the supporting block is adjustable with respect to the supporting rod 44. The ends of the supporting rod 44 are rotatably journalled in the supporting plates 25 and 26 so that the supporting block is pivotable about a pivotal axis parallel to the axis of rotation of the roller 15.

FIG. 4 furthermore shows that recesses 45 are provided in the supporting block at right angles to the direction of length of the set bolts 43 for receiving pins 46, whose ends protruding out of the supporting block are in contact with stops 47 fastened to the plates 25 and 26. The recesses 45 furthermore hold compression springs 48 loading the pins 46 and being enclosed between the ends of the pins and covering plates 49 fastened to the supporting block and covering the recesses 45. On these covering plates are bearing the ends of set bolts 50 screwed through tapped holes in ears 51 fastened to the supporting plates 25 and 26.

From the Figures it will furthermore be apparent that the guide member 42 has a stepped top surface, a face 52 of which, extending parallel to the rotary axis, constitutes a guide face for the elongate tape to be passed through the device and a rim 53 at right angles to said face constitutes a guide rim for the elongate tape.

On guide face 52 are resting three strips 54 of elatic material, for example, rubber or a synthetic resin, which form the outer circumference of pressure wheels 55. These wheels 55 are fastened to the ends of shafts 56 journalled in supporting housings 57. Each housing 57 is pivotally coupled with a supporting piece 59 with the aid of a horizontal pivot pin 58 extending at right angles to the shaft 56. The supporting piece 59 is connected with the supporting block 41 with the aid of a spring-loaded bolt 60 crossing the shafts 56 and 58 at right angles and can be fixed in various positions with respect to said supporting block by means of a clamping bolt 61.

Figure 6:
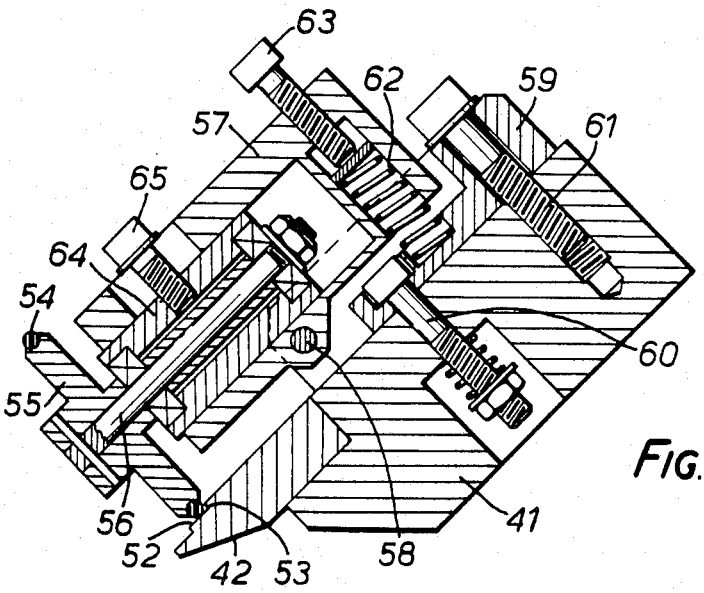
FIG. 6 is a sectional view of part of FIG. 3 taken on the line VI—VI in FIG. 3.

A compression spring 62 arranged between the housing 57 and the supporting member 59 the bias tension of which spring is adjustable with the aid of a set bolt 63, tends to turn the housing 57 in anti-clock wise direction, as viewed in FIG. 6, about the pivotal shaft 58 and hence to firmly press the strip 54 forming the outer circumference of the wheel 55 against the guide face 52.

It will be furthermore apparent from FIG. 6 that the shaft 56 of the wheel 55 is journalled in a sleeve 64 arranged in the housing 57 and being adjustable in the direction of length of the shaft 56 with respect to the housing 57 and fixable in the desired position by means of a guard bolt 65.

The plates 25 and 26 supporting the supporting block 41 and the parts fastened thereto and the two rollers 15 and 31 are clamped tight to supporting strips 67 fastened to the frame 7' with the aid of bolts 68 and 69 passed through vertical slots in the strips 69. The bolts 68 are passed through sleeves 70 fastened to the lower ends of vertical stubs 71. The stubs are passed through holes in supporting plates 72 fastened to the frame 7', whilst nuts 73 are screwed onto the ends of the stubs located above the supporting plates 72. It will be obvious that after the stubs 67 and 68 are loosened the supporting plates 25 and 26 and the parts supported by said plates can be moved vertically up and down by turning the set nuts 73 so that the extent of immersion of the roller 15 in the fluid contained in the reservoir 1 can be controlled, whilst the position of the supporting block 41 with the parts supported thereby relative to the roller 15 is not varied.

As stated above, the device is particularly intended for the local application of a metal coating to tape-shaped material to be passed through the device. A potential embodiment of such an elongate tape is shown in FIG. 1. In this embodiment the elongate tape comprises a plurality of elongate metal contact parts 74 punched from strip-shaped material and adhering to one another by bridges 75 integral with said contact parts. In the embodiment shown one end 76 of the contact part 74 is curved; it may be desired, for example, to provide the conve side 77 of this curved part 76 with a metal coating, for example, of gold or similar material. For this purpose the tape is passed through the device described above so that the ends of the elongate objects 75 remote from the curved parts 76 are guided along the guide face 52 and thus urged against this guide face by the wheels 55.

Figure 3:
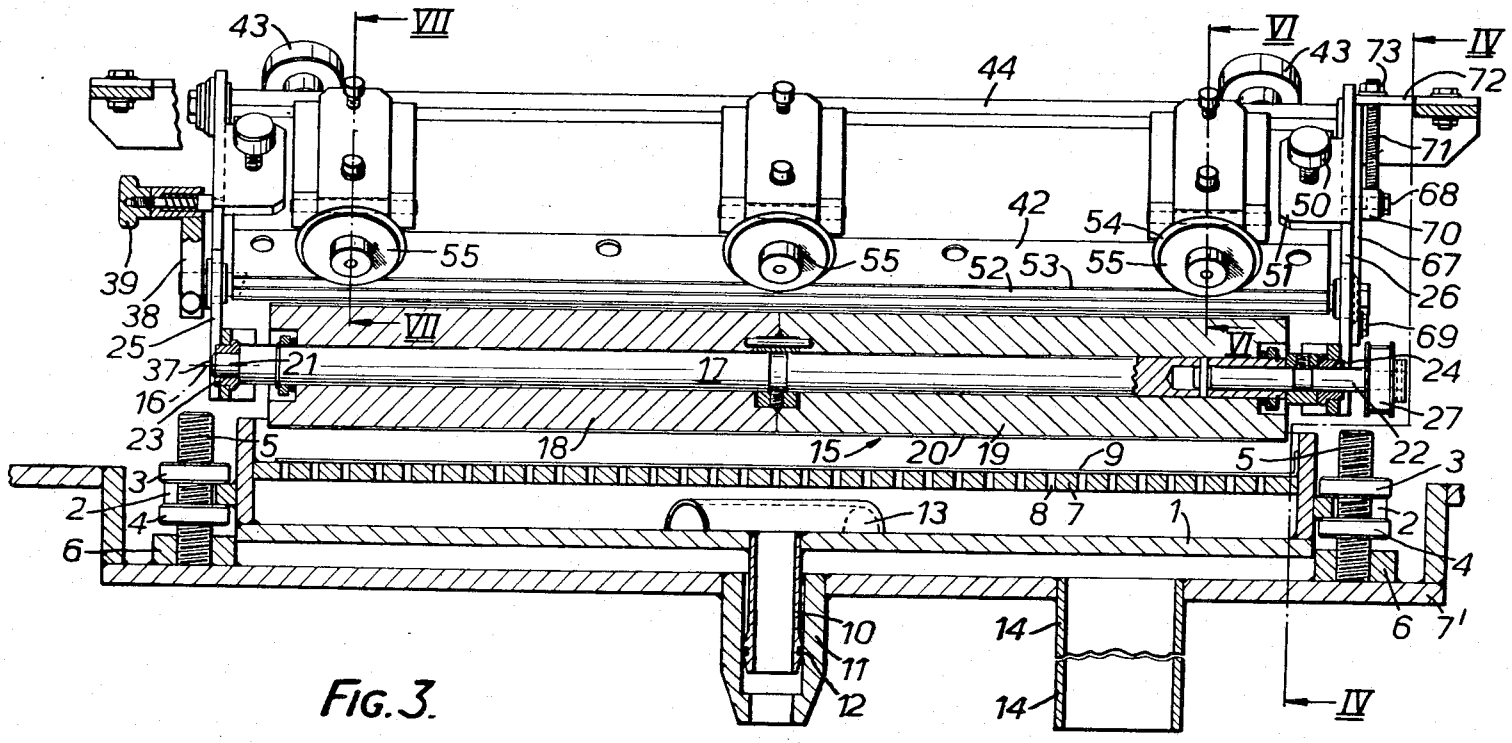
FIG. 3 shows an embodiment of a device in accordance with the invention partly in an elevational view and partly in a sectional view taken on the line III—III in FIG. 4, in which the wheels urging the elongate tape to be worked against the guiding surface and the guiding rim are disposed so that their rotary axes are at least substantially normal to the intended direction of displacement of the elongate tape through the device.
Figure 5:
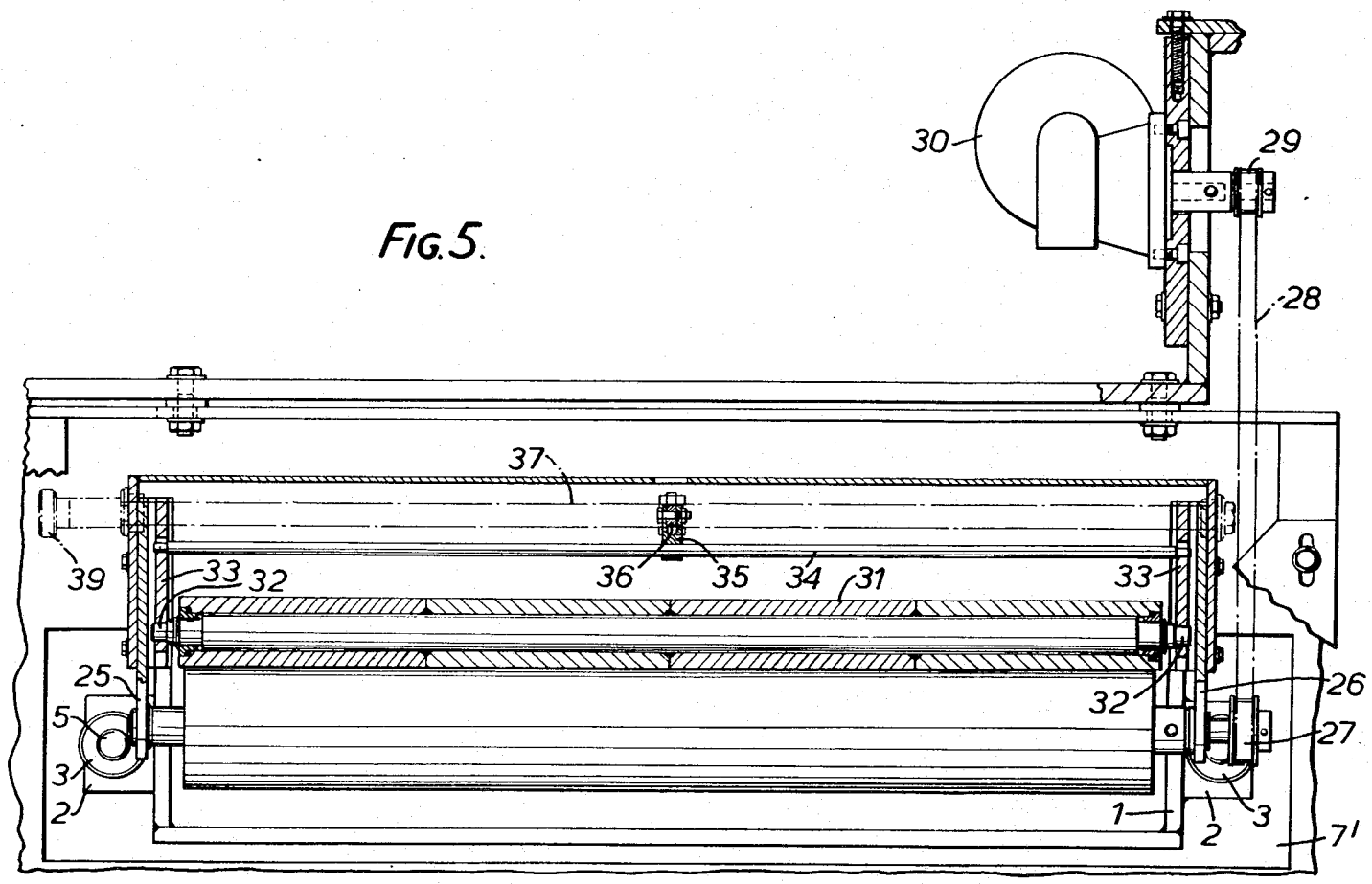
FIG. 5 is a sectional view of the embodiment of FIG. 4 taken on the line V—V in FIG. 4.
Figure 7:
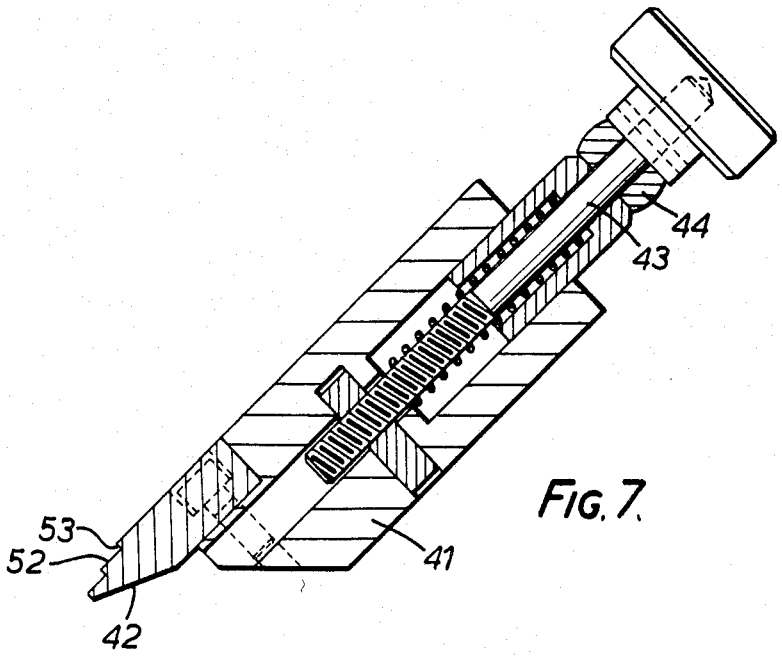
FIG. 7 is a sectional view taken on the line VII—VII in FIG. 3.

If, as shown in FIG. 3, the elongate tape is passed from left to right through the device, the housings 57 supporting the wheels 55 will arrive by turning about the bolts 60 at a position in which the rotary axes of the wheels 55 are upwardly inclined to the left (FIG. 3). Therefore, the freely rotating wheels 55, which urge the endless tape, as stated above, against the guide face 52 of the guide member 42, will also tend to displace the tape upwards, as viewed in FIG. 3, so that the ends of the elongate objects are pressed against the guide rim 53. It will be obvious that in this way an accurate positioning of the elongate tape with respect to the guide member 42 is obtained. The correct position of the guide member 42 with respect to the roller 15 can be ensured prior to starting the treatment of the metal tape by correct adjustment of the supporting block with the aid of the set bolts 43 so that the guide rim 53 extends parallel to the rotary axis of the roller 15 and with the aid of the set bolts 50 so that the guide face 52 is also parallel to the rotary axis of the roller 15 and the curved parts 76 come just into contact by their curved faces 77 with the fluid-absorbing layer 20 of the roller 15 during operation.

It will be obvious that the curved faces 77 to be provided with a metal layer will brush past the fluid-absorbing layer 20 during operation so that these parts of the tape acting as a cathode will be provided in the desired manner with a metal coating.

Since the fluid-absorbing layer 20 constantly supplies fresh electrolyte, the objects can be satisfactorily coated. The anode is arranged at a relatively large distance from the layer 20 so that substances which may be set free at the anode and which might have an adverse effect on the metal precipitation to be obtained will not come into contact with the metal tape.

In the embodiment shown a tape may, as an alternative, be passed from right to left through the device, as viewed in FIG. 3, in which case the wheels 55 are disposed so that, as shown in FIG. 3, the rotary axes are upwardly inclined to the right.

It will be obvious that flat objects united in a tape or flat metal tapes rather than objects having convex contact ares may also be worked by means of the device embodying the invention. By disposing the centre line 16 of the roller 15 at an acute angle to the longitudinal axis of the meal tape, the width of that part of the tape which has to be provided with a coating can be made larger than in the case in which the rotary axis 16 is parallel to the longitudinal axis of the tape.

I claim:

1. An electroplating apparatus for locally applying a metal layer to an elongate metal tape or to metal objects united in an elongate tape or the like in which the tape, acting as a first electrode, is guided along a main roller coupled to a frame so as to rotate about a rotary axis in operation and be dipped at least partly in an electrolyte solution contained in a reservoir having a second electrode and arranged below said main roller, and in which the tape is displaced generally parallel to the rotary axis of the main roller in a manner such that the parts of the tape to be provided with the metal layer come into contact with the main roller, wherein the improvement comprises a guide surface, disposed adjacent the main roller and stationery during operation in the direction of displacement of the tape, along which guide surface the tape is displaced during operation, and a guide rim protruding out of the guide surface remote from the main roller and extending generally parallel to the rotary axis of the main roller, against which guide rim an edge of the elongate tape is pressed, and a plurality of wheels pressing the tape against the guide surface and the tape edge against the guide rim, the wheels having their rotational axes at an acute angle to the direction of displacement of the tape.

2. An apparatus as claimed in claim 1 further comprising means for adjusting the angle between the rotational axes of the wheels and the direction of displacement of the tape.

3. An apparatus as claim in claim 1 further comprising means for permitting resilient deflection of the wheels with respect to the guide surface.

4. An apparatus as claimed in claim 1 further comprising means for permitting resilient deflection of the guide surface with respect to the main roller, transversely to the direction of length of the main roller.

5. An apparatus as claimed in claim 1 further comprising means for adjusting the guide surface in two directions at right angles to the longitudinal axis of the main roller.

6. An apparatus as claimed in claim 1 further comprising means for relatively adjusting the reservoir and main roller with respect to each other generally traversely to the direction of length of the roller.

7. An apparatus as claimed in claim 1 further comprising means for adjusting the reservoir in a generally vertical direction.

8. An apparatus as claimed in claim 1 further comprising means for commonly adjusting frame portions supporting the main roller, guide surface, guide rim, and the wheels in a generally vertical direction.

9. An apparatus as claimed in claim 1 further comprising a pressure roller disposed adjacent and generally parallel to the main roller and cooperating with the main roller, and means for adjusting the pressure roller with respect to the main roller transversely to the longitudinal axis of the main roller.

10. An apparatus as claimed in claim 1 further comprising an outlet pipe coupled to the bottom of the reservoir, above which pipe is arranged a covering hood deflecting an affluent from the pipe towards the ends of the reservoir, whilst in the reservoir a perforated plate is arranged above the covering hood at least substantially parallel to the bottom of the reservoir.

11. An apparatus as claimed in claim 10 wherein the second electrode is arranged above the perforated plate and in generally parallel relationship thereto.

12. An apparatus as claim in claim 1 further comprising means for displacing the wheels generally parallel to their axis of rotation.

13. In an electroplating apparatus for locally applying a metal layer to a metallic workpiece configured as an elongated tape and acting as a first electrode wherein the electroplating device includes a frame, a reservoir coupled to the frame, an electrolyte solution and a second electrode both disposed in the reservoir, and a main roller rotatably coupled to the frame and disposed above the reservoir so as to be at least partially immersed in the electrolyte solution, wherein the metallic workpiece tape is displaced generally parallel to the rotational axis of the main roller such that a portion of the metallic workpiece tape to be provided with a metal layer contacts the main roller, the improvement comprising:

a guide surface disposed adjacent the main roller having a guide rim protruding out of a portion of the guide surface distant from the main roller and extending generally parallel to the rotational axis of the main roller; and a plurality of wheels, coupled to the guide surface, for urging the metallic workpiece tape against the guide surface and a first edge of the metallic workpiece tape against the guide rim wherein the portion of the metallic workpiece tape to be provided with a metal layer is oriented with respect to the main roller.

14. The apparatus of claim 13 wherein the rotational axis of the wheels are oriented at an acute angle to the direction of displacement of the metallic workpiece tape.

15. An apparatus as claimed in claim 13 further comprising a means for adjusting the angle between the rotational axis of the wheels and the direction of displacement of the metallic workpiece tape.

16. An apparatus as claimed in claim 13 further comprising means for displacing the wheels in a direction generally parallel to the axis of rotation of the wheels.

17. An apparatus as claimed in claim 13 further comprising a means for displacing the guide surface in two directions generally at right angles to the longitudinal axis of the main roller.

18. An apparatus as claimed in claim 12 further comprising:

an outlet pipe coupled to the bottom of the reservoir for supplying an affluent to the reservoir;

a covering hood connected to the reservoir and disposed above the outlet pipe for deflecting the affluent towards a first and second end of the reservoir; and a perforated plate connected to the reservoir and disposed above the covering hood generally parallel to the bottom of the reservoir.

* * * * *